US005484316A

United States Patent [19]

Poirier

[11] Patent Number: 5,484,316

[45] Date of Patent: Jan. 16, 1996

[54] SOUND EFFECTS BELT

[76] Inventor: Mark E. Poirier, 1041 Westward Way, Costa Mesa, Calif. 92627

[21] Appl. No.: 346,573

[22] Filed: Nov. 29, 1994

[51] Int. Cl.[6] ..... A63H 33/00; A63H 33/30; A63H 5/00

[52] U.S. Cl. ..... 446/28; 446/144; 446/404

[58] Field of Search ..... 84/604, 645, 666; 446/28, 26, 143, 144, 145, 299, 302, 303, 404, 408, 397; 2/312, 320; 224/224, 904

[56] References Cited

U.S. PATENT DOCUMENTS

| | | | |
|---|---|---|---|
| 1,504,030 | 8/1924 | Dottweider | 224/224 X |
| 2,582,699 | 1/1952 | Jelaso et al. | 446/28 |
| 3,383,114 | 5/1968 | Ryan | 434/159 X |
| 3,664,560 | 5/1972 | Perkins | 2/312 X |
| 4,073,416 | 2/1978 | McComber | 224/224 X |
| 4,771,927 | 9/1988 | Ventura | 224/904 X |
| 4,820,233 | 4/1989 | Weiner . | |
| 5,004,136 | 2/1991 | Leath | 224/904 X |
| 5,111,463 | 5/1992 | Weber | 84/645 X |
| 5,145,447 | 9/1992 | Goldfarb . | |
| 5,245,128 | 9/1993 | Araiza | 84/645 X |
| 5,316,515 | 5/1994 | Hyman . | |

FOREIGN PATENT DOCUMENTS

| | | | |
|---|---|---|---|
| 2560059 | 8/1985 | France | 446/26 |
| 5068752 | 3/1993 | Japan | 446/26 |

*Primary Examiner*—Robert A. Hafer
*Assistant Examiner*—D. Ned Muir
*Attorney, Agent, or Firm*—Patent Law & Venture Group; Gene Scott

[57] ABSTRACT

A novelty belt with a control pad for programming and actuating a variety of sound effects emitted through a speaker. The belt also includes a plurality of props that correspond to the sound effects, creating a thematic novelty toy.

7 Claims, 4 Drawing Sheets

SOUND EFFECTS BELT

FIELD OF THE INVENTION

This invention relates generally to sound effect toys and more particularly to a novelty belt with a control pad for programming and actuating a variety of sound effects emitted through a speaker.

BACKGROUND OF THE INVENTION

Invention and use of novelty belts is known to the public. As for example, U.S. Pat. No. 3,458,188 issued to Infante in 1969 discloses a pair of novelty belts that are joined together with an elongated elastic strap so that the wearers of the belts may dance face-to-face as an attached team. The joining strap between the belts may include signal lights that are actuated in accordance with the tension between the belts.

U.S. Pat. No. 4,715,839 issued to Ford et al. in 1987 discloses a novelty belt/toy combination in which the outer surface of the belt buckle has a strip of Velcro™ on it so that a toy, such as a miniature car, with a corresponding strip of Velcro™ can be secured to and removed from the belt as desired by the user.

Invention and use of audio sound effect toys are also known to the public. For example, U.S. Pat. No. 4,820,233 issued to Weiner in 1989 discloses a battery powered sound-producing amusement device for use in talking dolls, talking books, and any other talking-type toys. The invention has a read-only memory with recorded digital data of the desired sound effects, and a sound-producing unit for producing the sounds represented by the digital data recorded in the read-only memory.

U.S. Pat. No. 5,145,447 issued to Goldfarb in 1992 discloses a verbal sound toy that uses a microprocessor to produce one song or poem that has at least one space that allows the user to select a supplementary verbal sound segment to complete the song. The user selects the segment by pushing a button with a picture that corresponds with the desired segment. Preferably, the toy is thematic, with all of the selectable segments relating to a single subject, such as animals.

Another example of an audio toy is U.S. Pat. No. 5,092,810 issued to Kwan et al. in 1992. This invention is disclosed as an accessory to another toy, for example, as a backpack for a toy action figure. The toy audio device is an enclosure with a speaker and a plurality of batteries. A printed circuit board containing circuitry for generating audio signals is located in a space alongside the speaker under a side wall of the enclosure.

Obviously then, both novelty belts and audio toys are popular and well known to the public. However, the prior art discloses few inventions that integrate these two popular devices into a single novelty toy. The only such prior art combination is disclosed in U.S. Pat. No. 5,316,515 issued to Hyman et al. in 1994. In this invention the neck and head portion of a hobby horse is secured to the user's waist by a belt. A rein switch is supported within the interior of the horse's head and is responsive to pulling action upon the reins. A motion sensing switch is also supported within the head portion of the hobby horse and responds to motion of the user and hobby horse, and a pair of pressure sensitive switches are disposed proximate the forehead and mouth portions of the hobby horse and respond to simulated feeding and petting actions by the user. A sound producing circuit includes a battery powered system, a speaker and a sound sensitizing circuit that provides a plurality of sound outputs responsive to play activities sensed by the switches.

While this device effectively produces sounds triggered by the various motions of the user, it does not allow the user to select and actuate desired sound effects, nor does it allow sound effects to be emitted in a series. The design of the invention also limits it to sound effects dealing strictly with a horse theme. The present invention overcomes these disadvantages and provides further related advantages as described in the following summary.

SUMMARY OF THE INVENTION

The present invention is a novelty sound effects belt with a control pad that allows the user to program and actuate a series of desired sound effects. The belt also includes a series of props that may correspond with the sound effects and can be easily removed and replaced in the belt. Thus, it is an object of the invention to present a thematic novelty belt, complete with corresponding props and sound effects. For example, all of the props and sound effects could relate to animals, Sesame Street characters, the Power Rangers or the Three Stooges.

The belt is an adjustable belt sturdy enough to support numerous props and withstand wear and tear. A series of soft plastic or rubber props, as for example a hammer, wrench, paintbrush and water bottle, are attached along the exterior of the belt by means of straps, hooks or any other type holder suitable for quick removal and replacement of the props.

A control pad and speaker box are secured in separate holders near the buckle at the front of the belt so that the control pad is easily reachable by the belt wearer. The control pad and the speaker are connected to one another with a stretchable cord, allowing one to be removed from the belt while the other remains in its holder. The speaker box includes a battery holder and a switch for controlling the power of the speaker and the volume of the emitted sound effects.

The exterior of the control pad contains a dial and a series of buttons. The name of each sound effect is written or illustrated around the dial so that the dial can be easily turned to point at the desired sound effect. The device is capable of storing nearly twenty sound effects or more. The series of buttons allows the user to activate the selected sound effect, or to program a series of continuous playing sound effects.

The selectable buttons include ENABLE, PROGRAM, ENTER, REPEAT, CLEAR and PLAY. Pressing the ENABLE button plays the sound effect on which the dial is currently positioned. The sound effect can be played repeatedly, according to the number of times the ENABLE button is pushed.

The ENTER button enters the desired effect into a memory line of sequenced sound effects, allowing the user to set up a series of sound effects to be played together in the order programmed. To do this, the user sets the dial at the first sound effect desired in the series, presses the PROGRAM button and then the ENTER button. The user moves the dial to the next effect desired in the series, and continues to repeat the process until the desired sequence is programmed.

The REPEAT button allows the user to program any sound effect to be played repeatedly. The button is pressed for each time the effect is desired, and then the ENTER button is pressed. The REPEAT button can be used in conjunction with the PROGRAM button.

When the desired sound effect series is programmed, the PLAY button plays the series of sound effects entered into the memory line in the order programmed. The CLEAR button is used to erase the existing programmed series.

Thus, it is an object of the invention to allow the user to create a multitude of original sound effect series, so that the combination of possible sequences is virtually endless. This is particularly desirable when the toy is intended for use with children, as the immense variety of possible combinations holds and keeps their interest in the toy for a substantially longer period of time than otherwise possible.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

FIGS. 1–5 illustrate the prefered mode of a novelty that produces audible sounds 6. Preferably, the novelty also includes props 20 that correlate with the sounds 6, so that a prop 20 can be played with while the corresponding sound 6 is emitted. Preferably the audible sounds 6 and the props 20 all refer to a particular theme, such as a television program, cartoon characters, animals or the like.

Figure 1:
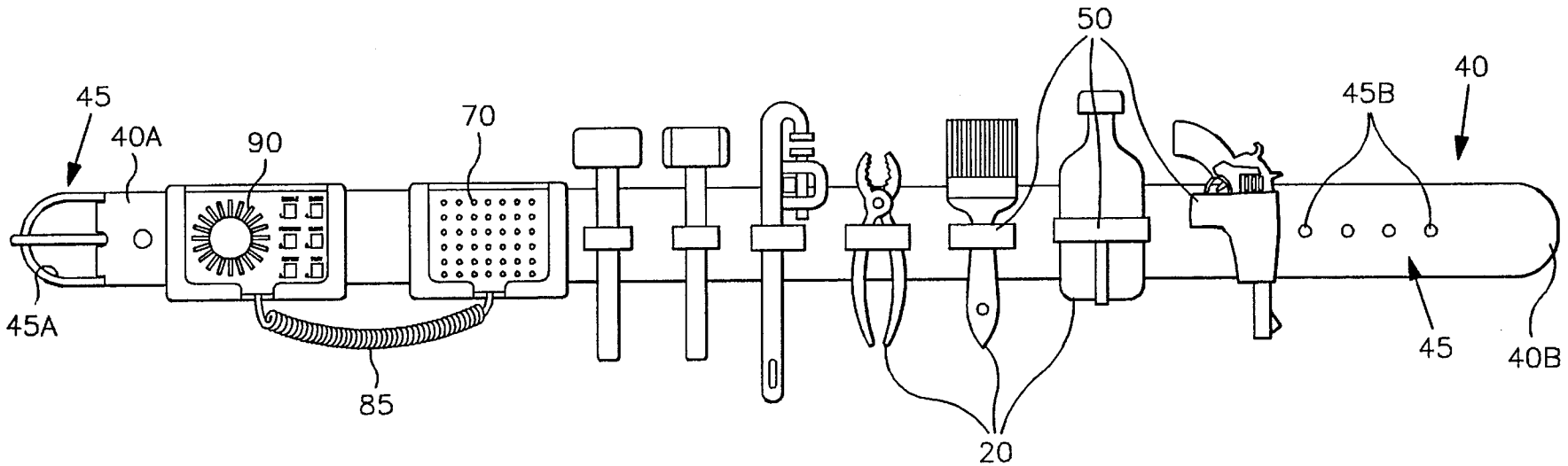
FIG. 1 is an elevational view of a preferred embodiment of the invention, particularly showing a belt having facility for carrying a sound selection box, a speaker box, and a variety of tools and other toy props.

The novelty is designed to be worn around a waist of the user by means of a utility strap-on belt 40. As best shown in FIG. 1, the belt 40 encircles the user's waist and is secured with a two-part attachment means 45, a first part 45A positioned on a first end 40A of the belt 40, and a second pan 45B positioned on a second end 40B of the belt 40. In one embodiment, as shown in FIG. 1, the first pan of the attachment means 45A is a buckle, and the second part 45B is a series of adjustment holes. However, any other type attachment means 45 can also be used, providing it allows the belt 40 to be easily adjusted to fit a range of body sizes.

The length of the belt between the two attachment parts 45A and 45B includes a plurality of prop holding means 50 that are individually adapted for carrying a particular prop 20. Typically, the prop holding means 50 are a series of cloth or plastic strips, although hooks, Velcro™ or other means could be used. The holding means 50 are configured so that the prop 20 cannot fall out of it, but instead must be deliberately removed. Each prop holding means varies according to the nature of the prop 20 it is designed to hold. For example, as seen in FIG. 1, a gun prop 20 would typically be housed in a holster-type prop holding means 50. Preferably, the props 20 are created of lightweight plastic or cloth so that they are easily secured in the holding means 50 and do not add a significant amount of weight to the wearer's waist.

An electrical circuit 80 (FIG. 5) is also provided to store and program sound effect signals and emit the corresponding audible sounds 6. The circuit 80 is preferably contained within a first and second enclosure, 70 and 90 respectively, that are positioned near either end of the belt 40A or 40B so that they are within easy reach of the belt wearer. The enclosures 70 and 90 are held to the belt 40 with individual holding means 50, so that they may be easily removed from the belt 40 when desired. An electrical cable 85 connects the two enclosures 70 and 90 together. Preferably, the electrical cable 85 is a coiled or retractable cord, so that one of the enclosures 70 or 90 may be removed from its holding means 50 and adjusted while the other remains in position on the belt 40.

Figure 4:
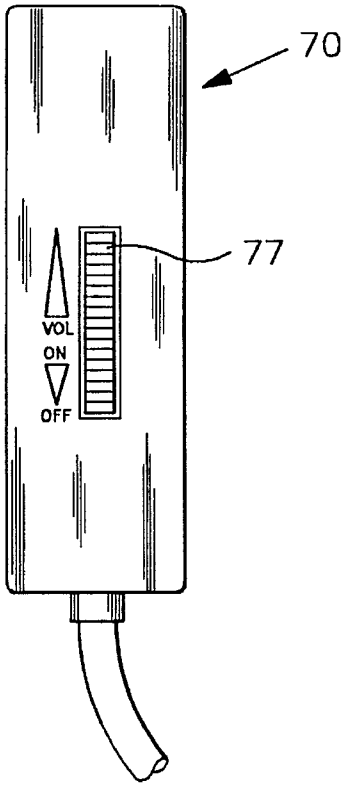
FIG. 4 is a side elevational view of the speaker box particularly showing a volume control thereof.
Figure 3:
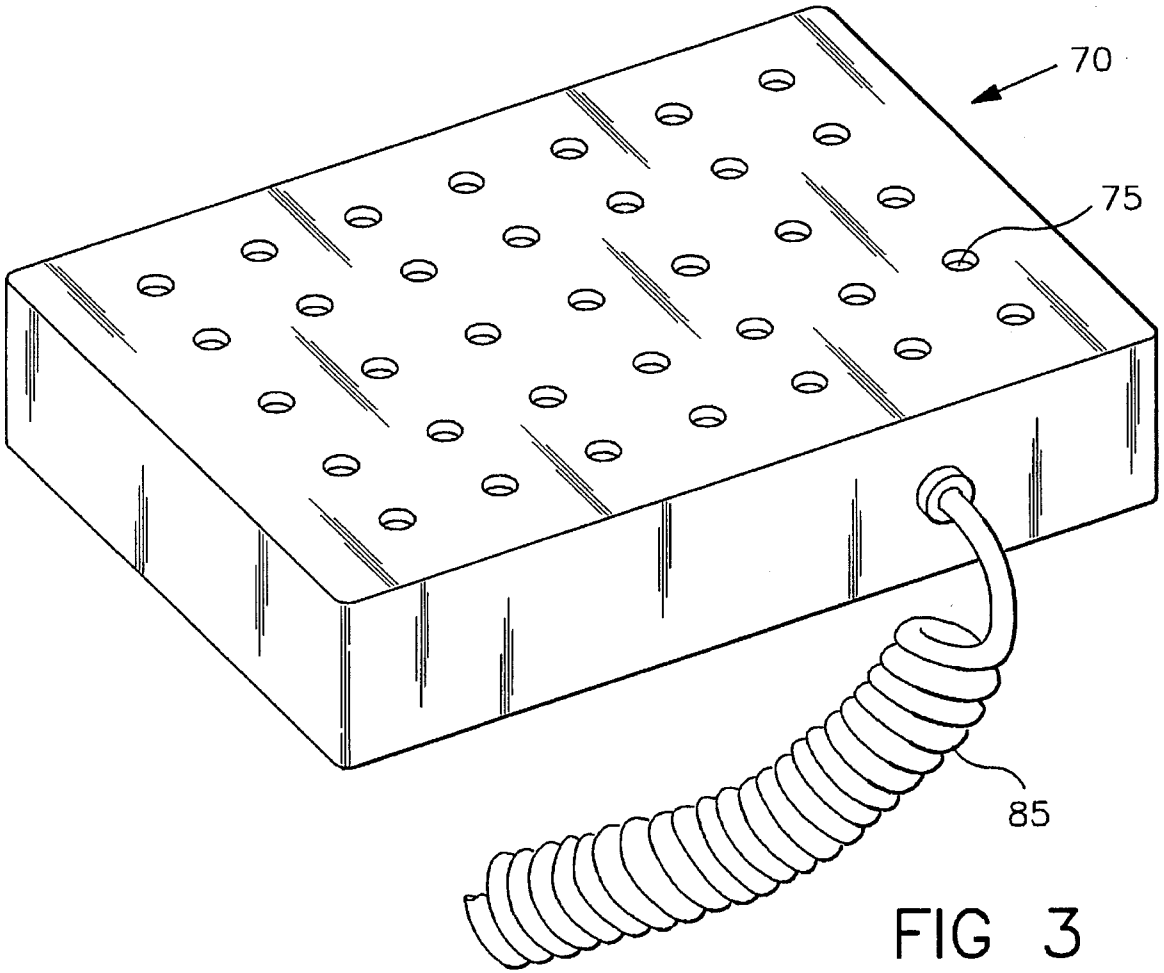
FIG. 3 is a perspective view of the speaker box thereof.
Figure 5:
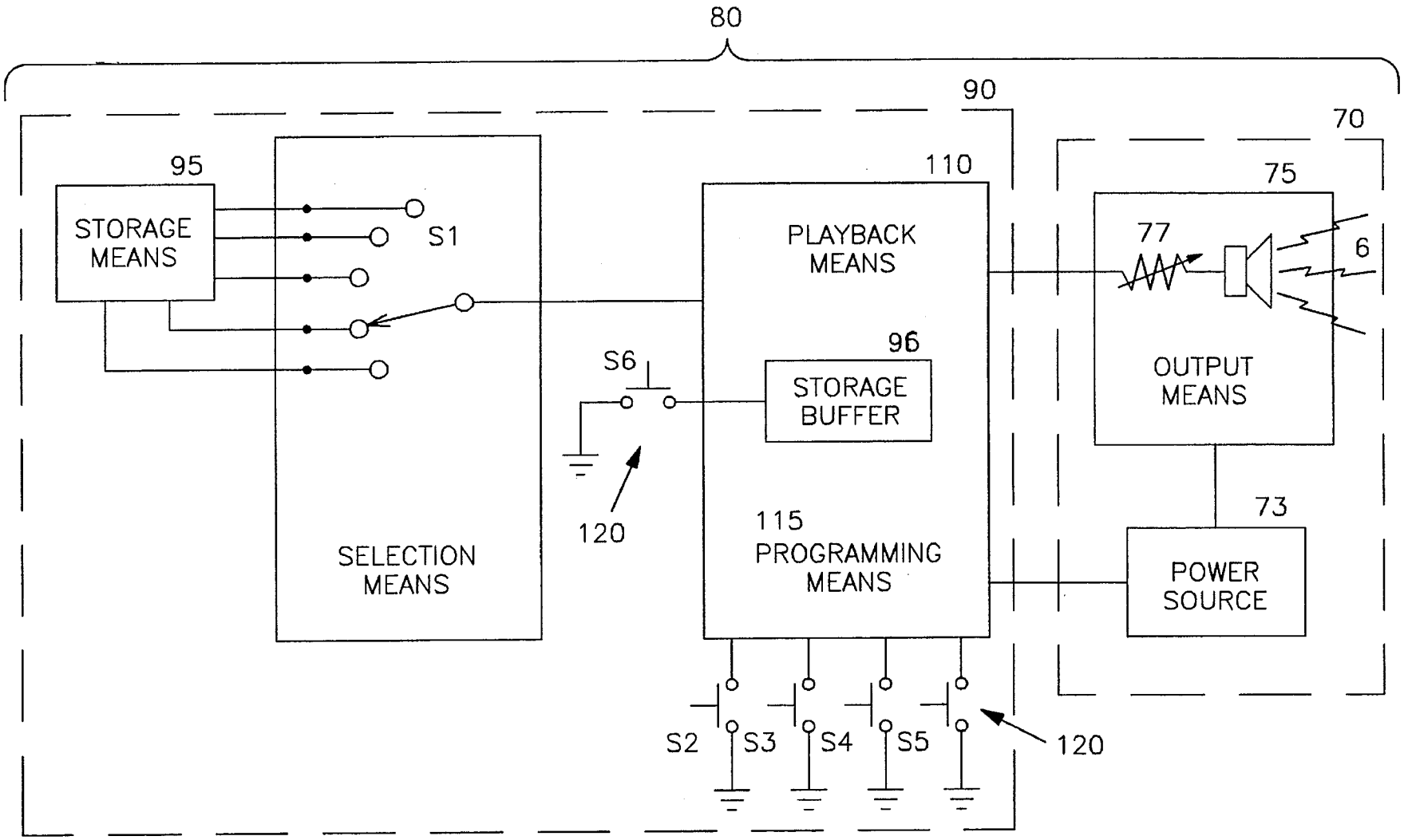
FIG. 5 is a block diagram of the electrical circuit of the preferred embodiment showing the main components of said circuit.

FIGS. 3 and 4 show the first enclosure 70 which includes a sound output means 75, such as a speaker, for emitting desired audible sounds 6, and a power switch 77 by which the circuit's power and the volume of the sounds 6 are controlled. The circuit 80 is powered by a portable electric power source 73, preferably batteries, which is also included in the first enclosure 70.

The second enclosure 90 houses a sound signal storage means 95, preferably a solid state memory device that stores the different sound effects signals, a sound signal selection means S1 that allows the user to select which audible sound 6 is to be emitted, a playback means 110 that plays back the selected sound effect signal, and a sound clearing means, part of the playback means 110, that clears previously selected sound effect signals.

Figure 2:
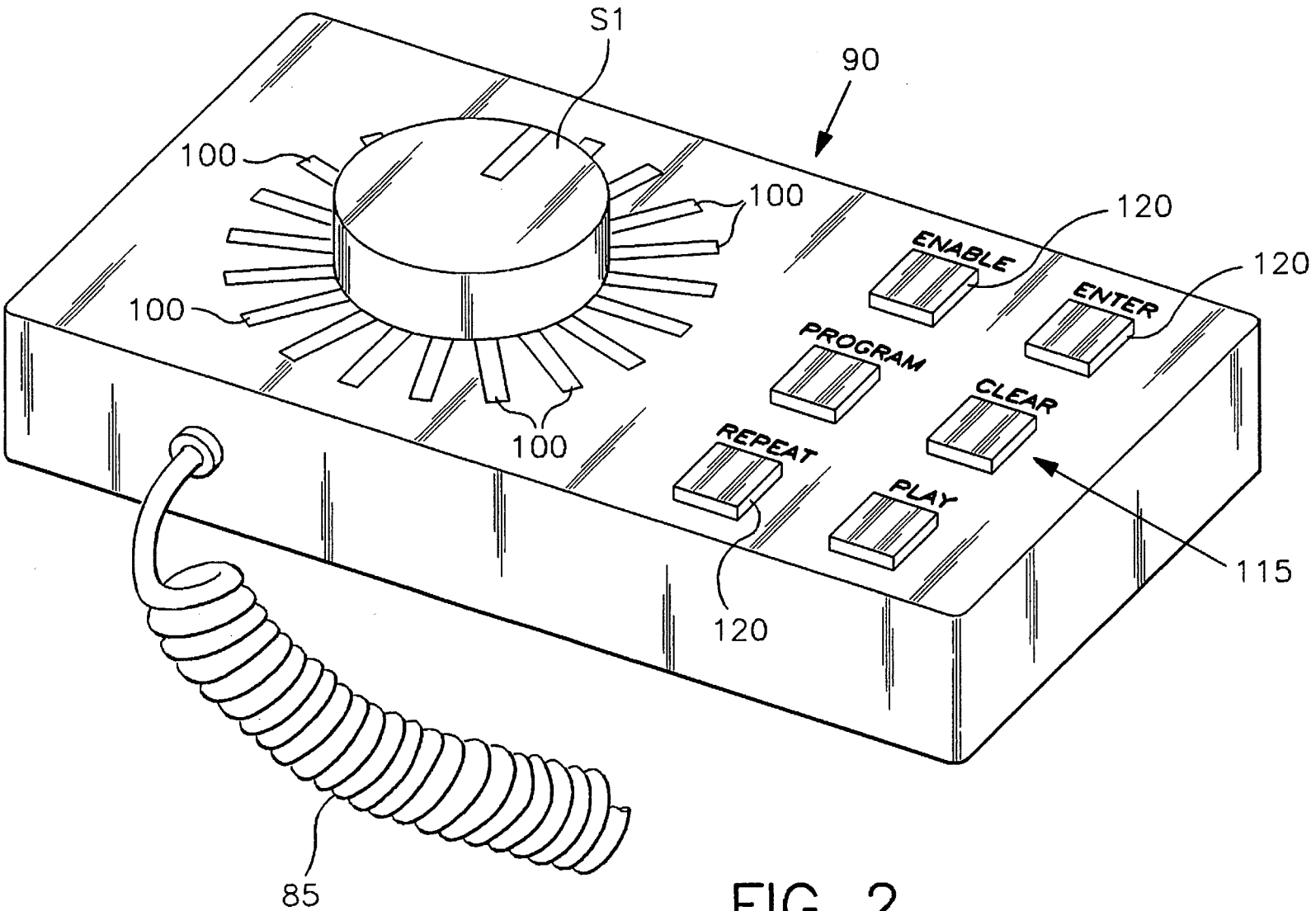
FIG. 2 is a perspective view of the sound selection box thereof.

The user is able to select audible sounds 6 to be emitted by manipulating the sound signal selection means S1. As shown in FIG. 2, the selection means S1 is preferably a multiple position switch or dial, although push buttons or other such selection means S1 can also be used. Pictures or words that indicate a specific sound effect signal may be located at each possible position 100 of the selection means S1, indicating the audible sound 6 that corresponds with that particular position 100 of the selection means S1. Thus, to select a particular sound effect signal, the selection means S1 is simply moved to the appropriate position 100.

The playback means 110 includes an external programming means 115 with a series of circuit closure means 120 (S2–S6 in FIG. 5) that are used to program and trigger the emission of the selected sounds 6. There are many ways in which the series of circuit closure means 120 can be arranged and configured, although they are preferably push buttons. FIG. 2 shows one possible arrangement of the series of circuit closure means 120. As shown in this embodiment, each of the circuit closure means 120 include a word to indicate the function of each particular closure means 120. The series of circuit closure means 120 will be described as detailed in FIG. 2, but the novelty is in no way limited to this embodiment.

When the selection means S1 is positioned on the desired sound effect signal, the user activates the ENABLE circuit closure means 120 to emit the corresponding audible sound 6, the sound 6 playing in accordance with the number of times the ENABLE closure means 120 is activated. It is also possible to program several sound effect signals into a sequence that can be played at the user's discretion. To do this, the user positions the selection means S1 to the first sound effect signal to be programmed into the sequence, and then activates a PROGRAM closure means 120 immediately followed by an ENTER closure means 120. Activating the ENTER closure means 120 places the selected sound effect signal into a storage buffer 96. To program the next sound effect signal into the series, the selection means S1 is repositioned and again the PROGRAM and the ENTER closure means 120 are activated. If the user desires an audible sound 6 to be repeated in the series, a REPEAT closure means 120 and the ENTER closure means 120 are activated as many times as the sound effect is to play. This process is repeated until the desired sound effect sequence is programmed. Then, each time a PLAY closure means 120 is activated, the entire sound effect series is emitted. A CLEAR closure means 120 is activated to erase the existing programmed series.

Depending on the theme and target age range of the users, the series of circuit closure means 120 can be modified to decrease or increase its complexity.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A novelty for producing audible sounds for play comprising:

a utility strap-on belt for wearing around the waist, the belt having two-part attachment means, a first end of the belt having a first part of the two-part attachment means, with a second end of the belt providing a second part of the two-part attachment means, the first and the second parts being engagable for closing the belt around a waist of a wearer so that the belt is secured therearound, the belt further providing a plurality of prop holding means;

an electrical circuit attached to the strap-on belt providing, sound signal storage means for storing a plurality of sound effects signals, sound signal selection means for choosing at least one of the sound effects signals for playback, playback means for enabling the playback of the selected sound effects signals, sound clearing means for clearing previously selected sound effects signals, sound output means for producing audible sounds from the selected sound effects signals, and a portable electrical power source;

a plurality of props, each of the prop holding means adapted for carrying at least one of the props and for holding the electrical circuit;

at least one of the sound effects being similar to a sound made by at least one of the props, whereby, in play, a prop may be removed from the belt and used in play while enunciating the corresponding sound from the sound output means to provide for more realistic play.

2. The novelty of claim 1 wherein the sound output means and the power source are mounted within a first enclosure attached to the strap-on belt.

3. The novelty of claim 2 wherein the storage means, the selection means, the playback means, and the clearing means are mounted within a second enclosure attached to the strap-on belt, the first and second enclosures being in communication through an electrical cable.

4. The novelty of claim 3 wherein the storage means is a solid state memory device.

5. The novelty of claim 3 wherein the selection means is a multiple position switch.

6. The novelty of claim 3 wherein the playback means includes a program means including a repeat circuit closure means, for selecting one of the sound effects signals repetitively.

7. The novelty of claim 3 wherein the playback means includes an enable circuit closure means for starting the audible sound effect selected by the selection means, and a play circuit closure means for starting the audible sound effect sequence selected by the repeat circuit closure means and by an enter circuit closure means, the enter circuit closure means placing at least one sound effect signal into a storage buffer 96 in a stored sequence of said sound effects signals.

* * * * *